US006334915B1

(12) United States Patent
Ogura et al.

(10) Patent No.: US 6,334,915 B1
(45) Date of Patent: Jan. 1, 2002

(54) COPPER ALLOY SHEET FOR ELECTRONIC PARTS

(75) Inventors: Tetsuzo Ogura; Takashi Hamamoto; Masahiro Kawaguchi, all of Shimonoseki (JP)

(73) Assignee: Kabushiki Kaish Kobe Seiko Sho, Kobe (JP)

( * ) Notice: Subject to any disclaimer, the term of this patent is extended or adjusted under 35 U.S.C. 154(b) by 0 days.

(21) Appl. No.: 09/272,336

(22) Filed: Mar. 19, 1999

(30) Foreign Application Priority Data

Mar. 26, 1998 (JP) ..... 10-100007
Sep. 22, 1998 (JP) ..... 10-267557

(51) Int. Cl.[7] ..... C22C 9/06
(52) U.S. Cl. ..... 148/435; 420/485; 420/486; 420/487; 420/488
(58) Field of Search ..... 148/435; 420/485, 420/486, 487, 488

(56) References Cited

U.S. PATENT DOCUMENTS 4,594,221 A 6/1986 Caron, et al. ..... 420/485
4,692,192 A * 9/1987 Ikushima et al. ..... 148/414
5,124,124 A * 6/1992 Ohashi et al. ..... 420/473

FOREIGN PATENT DOCUMENTS

DE 43 19 249 12/1993
EP 0 501 438 9/1992
JP 2-66130 3/1990
JP 3-236432 10/1991
JP 4-99839 3/1992
JP 04231443 * 8/1992
JP 06041660 * 2/1994

OTHER PUBLICATIONS

Patent Abstracts of Japan, vol. 16, No. 560 (C–1008), Dec. 2, 1992, JP 04 218632, Aug. 10, 1992.
Patent Abstracts of Japan, vol. 17, No. 625 (E–1461), Nov. 18, 1993, JP 05 198247, Aug. 6, 1993.
Patent Abstracts of Japan, vol. 16, No. 234 (C–945), May 29, 1992, JP 04 048041, Feb. 18, 1992.
Patent Abstracts of Japan, vol. 13, No. 182 (C–591), Apr. 27, 1989, JP 01 011933, Jan. 17, 1989.

* cited by examiner

*Primary Examiner*—Sikyin Ip
(74) *Attorney, Agent, or Firm*—Oblon, Spivak, McClelland, Maier & Neustadt, P.C.

(57) ABSTRACT

A copper alloy sheet comprises 0.4 to 2.5 wt % of Ni, 0.05 to 0.6 wt % of Si, 0.001 to 0.05 wt % of Mg, and the balance being Cu and inevitable impurities wherein an average grain size in the sheet is in the range of 3 to 20 $\mu$m and a size of an intermetallic compound precipitate of Ni and Si is in the range of 0.3 $\mu$m or below. If necessary, the sheet may further comprise one or more of 0.01 to 5 wt % of Zn, 0.01 to 0.3 wt % of Sn, 0.01 to 0.1 wt % of Mn, and 0.001 to 0.1 wt % of Cr. It is preferred that when an X-ray diffraction intensity from {200} plane in the surface of said sheet is taken as I{200}, an X-ray diffraction intensity from {311} plane is taken as I{311}, and an X-ray diffraction intensity from {220} plane is taken as I{220}, the following equation is satisfied $$[I\{200\}+I\{311\}]/I\{220\} \geqq 0.5$$

17 Claims, 3 Drawing Sheets

A: INITIAL CONTACT FORCE WHEN PINS ARE SMALL IN NUMBER

A': INITIAL CONTACT FORCE WHEN PINS ARE LARGE IN NUMBER

B: STANDARD CONTACT FORCE NECESSARY FOR TERMINAL

C: A QUANTITY OF STRESS RELAXATION ALLOWED WHEN THE PIN NUMBER IS SMALL (= A - B)

C': A QUANTITY OF STRESS RELAXATION ALLOWED WHEN THE PIN NUMBER IS LARGE (= A' - B)

COPPER ALLOY SHEET FOR ELECTRONIC PARTS

BACKGROUND OF THE INVENTION

1. Field of the Invention

This invention relates to a copper alloy sheet useful as electronic parts and particularly, those parts such as terminals/connectors, switches, relays, lead frames and the like. The copper alloy sheet of the invention has excellent mechanical properties and electrical conductivity, and are thus suitable for the above purposes. In addition, the alloy sheet has a good stress relaxation resistance characteristic and good bend formability, enabling the alloy sheet to show better performance upon use as electronic parts, such as terminals/connectors, switches, relays, lead frames and the like, which are required to be down-sized and are placed in a high temperature environment.

2. Description of the Related Art

It has been hitherto employed, as electronic parts such as terminals/connectors, copper alloys including brass (C26000), phosphor bronzes (C5111, C5191, C5212, C5210), Cu—Sn—Fe—P alloy (C50715), and the like. In recent years, there have also been used copper alloys such as Cu—Ni—Sn—P alloys, Cu—Ni—Si—Zn—Sn (—Ca—Pb) alloys, Cu—Ni—Si—Mg (—Zn) and the like. Patent documents concerning copper alloys, which belong to alloys of the same type as the copper alloy sheet of the invention and contain Ni and Si, include, for example, Japanese Laid-open Patent Application Nos. Hei 9-209061, Hei 8-319527, Hei 8-225869, Hei 7-126779, Hei 7-90520, Hei 7-18356, Hei 6-184681, 6-145847, 6-41660, Hei 5-59468, Hei 2-66130 and Sho 61-250134, and Japanese Patent Publication No. Sho 62-31060.

With the recent development of electronics, electronics parts such as terminals and connectors tend to be down-sized, for which more improved reliability thereof has been demanded. This is illustrated using, for example, terminals used in the field of automobiles. For the purposes of insuring an accommodation space, improving accommodation properties, and shortage of transmission wires (to permit location of electronic appliances in the vicinity of an engine for engine control), electronic and electric appliances mounted in an engine room increase in number. The increase in number of appliances for electronic control and the increase in amount of transmission signals results in an increase in number of pins of wire harnesses. Nevertheless, it becomes necessary to arrange a junction block and a terminal box in a narrow space, thus contemplating fabrication of more down-sized and more lightweight connectors.

In such down-sized and lightweight connectors, processing techniques such as 180 degree bending at 0 radius and bending after notching (i.e. a bent portion is notched and then bent) as shown in FIG. 1 or "notching" have been adopted for the purpose of making up for the lowering of rigidity caused by reduction in sheet or plate thickness and also ensuring high dimensional accuracy. When subjected to such a processing technique, existing copper alloys undergo generation of fine cracks at the bent portion, thus leaving the problem that when the resultant terminal is employed, its reliability lowers considerably.

In the connection operation of connectors, an insertion force expressed as (initial contact force of connector) X (coefficient of friction at the time of insertion) X (pin number)is needed. If the initial contact forces of terminals are at the same level, the increase of the pin number results in an increasing insertion force. This is one of factors contributing to increasing the fatigue of workers who perform assembling operations. In order to suppress the insertion force from increasing after the increase in the pin number, it have become necessary to reduce the initial contact force of terminals substantially in reverse proportion to the increase in the pin number. However, when terminals are formed of a copper alloy material having the same stress relaxation rate, it is not possible to maintain a standard value of a contact force necessary for keeping the reliability for use as a terminal. This is because an initial contact force of a down-sized terminal having a large number of pins is set at a low level, thus exerting stress relaxation on the terminal as time goes. Hence, in order to keep a given contact force B necessary after passage of time, in terminals having a large number of pins, there is required a specific type of copper alloy material, which has a smaller initial contact force ($A'<A$) and a smaller degree of stress relaxation ($C'<C$), i.e. a smaller stress relaxation rate ($1-B/A'<1-B/A$) than those materials used as a terminal having an small number of pins. This is particularly shown in FIG. 2. In addition, such an alloy material should have high strength (yield strength) so that it can yield a substantial contact force on its use as a down-sized spring portion.

As will become apparent from the above, with the down-sizing of terminals, there are demanded copper alloy materials, which have better bend formability, stress relaxation resistance, and strength (yield strength) than existing copper alloys. Especially, with regard to the stress relaxation resistance characteristic, the higher performance of engines results in a higher temperature in an engine room. This strongly demands the development of copper alloys whose stress relaxation resistance is good at high temperatures exceeding 150° C.

In order to meet the above demand, attempts have been made on the processing step of terminals/connectors with the use of combinations of soft copper/copper alloys having good electrical conductivity and formability or processability and stainless steel materials having good yield strength and formability along with a good stress relaxation resistance. This presents the problem that the processing steps are complicated with poor economy. On the other hand, hitherto employed copper alloys, respectively, have the following problems. Conductivity and stress relaxation resistance are poor for bronze and phosphor bronze, stress relaxation resistance is poor for Cu—Sn—Fe—P copper alloys, and yield strength is poor for Cu—Ni—Sn—P alloys. This is true of Cu—Ni—Si alloys, e.g. Cu-2Ni-0.5Si-1Zn-0.5Sn(—Ca—Pb) alloys are poor in formability and stress relaxation resistance, and Cu-3Ni-0.65Si-0.15Mg alloys are poor in formability.

SUMMARY OF THE INVENTION

It is accordingly an object of the invention to provide an alloy material which overcomes the problems of the prior art counterparts.

It is another object of the invention to provide an alloy material which has good yield strength, electrical conductivity and stress relaxation resistance characteristic along with good formability sufficient to ensure 180 degree bending at 0 radius, and thus is suitable for use as electronic parts such as terminals/connectors, lead frames and the like.

We made intensive studies on Cu—Ni—Si alloys in order to solve the prior-art problems, and as a result, found that the above objects can be achieved by appropriately controlling the amounts of Ni, Si and Mg in Cu along with the amounts of Zn and Sn, if necessary, and also by appropriately controlling an average grain size of a product sheet and also a size of an intermetallic compound precipitate of Ni and Si.

More particularly, the invention contemplates to provide a copper alloy sheet which has good stress relaxation resistance and bend formability and is adapted for use as electronic parts, the copper alloy sheet comprising 0.4 to 2.5 wt % of Ni, 0.05 to 0.6 wt % of Si, 0.001 to 0.05 wt % of Mg, and the balance being Cu and inevitable impurities wherein an average grain size in the sheet is in the range of 3 to 20 μm and a size of an intermetallic compound precipitate of Ni and Si is in the range of 0.3 μm or below. The copper alloy sheet may further comprise 0.01 to 5 wt % of Zn and/or 0.01 to 0.3 wt % of Sn. If Sn is present, it is preferred that the following equation is satisfied when the content by wt % of Mg is represented by [Mg] and the content by wt % of Sn is by [Sn]

$$0.03 \leqq 6[Mg]+[Sn] \leqq 0.3$$

Further, the copper alloy may further comprise 0.01 to 0.1 wt % of Mn and/or 0.001 to 0.1% of Cr. Separately, at least one of Be, Al, Ca, Ti, V, Fe, Co, Zr, Nb, Mo, Ag, In, Pb, Hf, Ta and B may be further contained in the alloy in a total amount of 1 wt % or below.

When the X-ray diffraction intensity from plane {200} in the sheet surface is taken as I{200}, the X-ray diffraction intensity from plane {311} is taken as I{311}, and the X-ray diffraction intensity from plane {220} is taken as I{220}, the following equation should preferably be satisfied $$[I\{200\}+I\{311\}]/I\{220\} \geqq 0.5$$

In addition, It is preferred that the yield strength is 530 $N/mm^2$ or above.

PREFERRED EMBODIMENTS OF THE INVENTION

The components of the copper alloy sheet of the invention and their amounts are described below.

(Ni and Si)

These components have such an effect that they are able to form an intermetallic compound of Ni and Si in a co-existing condition and can improve a stress relaxation resistance and a yield strength without considerably lowering electrical conductivity. When Ni<0.4 wt % and Si<0.05 wt %, the above effect is not expected. On the contrary, when Ni>2.5 wt % and Si>0.6 wt %, bend formability lowers considerably. Accordingly, the content of Ni is in the range of 0.4 to 2.5 wt % and the content of Si is in the range of 0.05 to 0.6 wt %. Taking the yield strength and bend formability into account, it is preferred that the content of Ni is in the range of 1.5 to less than 2.0 wt % and the content of Si is in the range of 0.3 to 0.5 wt %.

It will be noted that among the intermetallic compound precipitates of Ni and Si, those precipitates that contribute to improving the stress relaxation resistance characteristic and the yield strength are ones which have a size of 0.3 μm or below. If precipitates whose size exceeds 0.3 μm are formed, precipitates which contribute to improving these characteristics become smaller in amount. Moreover, if precipitates having a size exceeding 0.3 μm are liable to cause cracks at the time of bend forming operations, thus resulting in the deterioration of bend formability. Accordingly, the precipitate size of the intermetallic compound of Ni and Si should preferably be 0.3 μm or below. In this connection, when the size of the intermetallic compound precipitate increases within a range of 0.3 μm or below, such precipitates become resistant to slip deformation at the time of bending, and thus, slip deformation is apt to be inhomogeneous thereby causing the surfaces to be wrinkled. In this sense, the precipitate size is more preferably in the range of 0.2 μm or below.

(Mg)

Mg is present in a Cu matrix in the form of a solid solution and can remarkably improve the yield strength and stress relaxation resistance characteristic only in small amounts without involving a considerable lowering of electrical conductivity when co-existing with the intermetallic compound of Ni and Si. However, as the amount increases, work hardening at the time of bending increases. This cause cracks to be generated at a bent portion. Thus, it is necessary to determine the content enough to satisfy both the stress relaxation resistance characteristic and the bend formability. If Mg<0.001 wt %, no effect of improving the stress relaxation resistance characteristic can be expected. On the contrary, if Mg>0.05 wt %, the bend formability considerably lowers, making 180 degree bending at 0 radius impossible. Hence, the content of Mg is in the range of 0.001 to 0.05 wt %, preferably in the range of 0.005 to 0.02 wt %.

Figure 1:
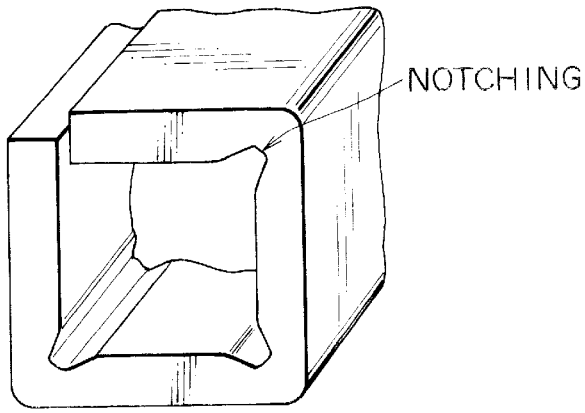
FIG. 1 is a schematic view illustrating notching.
Figure 2:
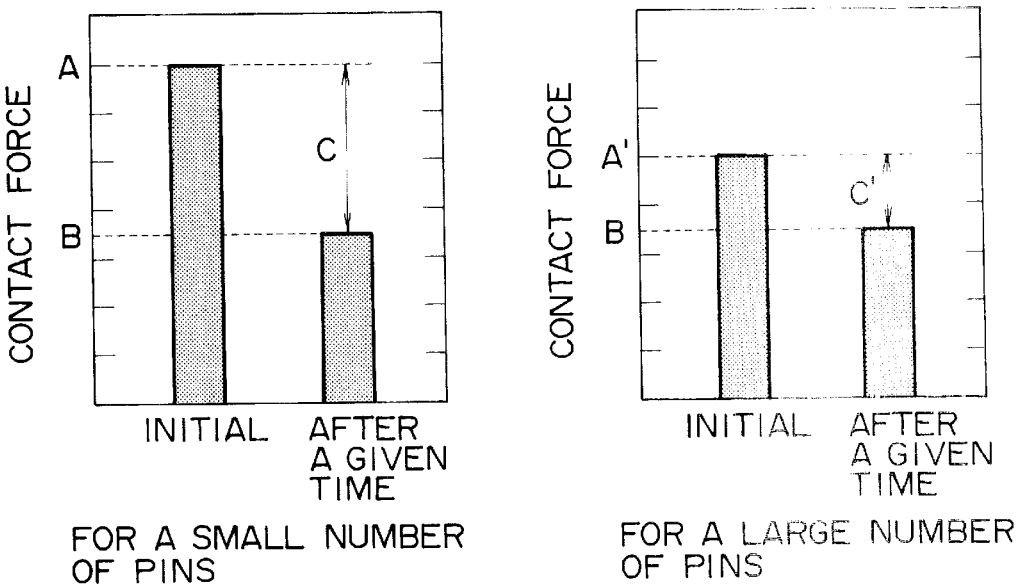
FIG. 2 is a view illustrating the reason why a copper alloy material having a good stress relaxation resistance is required for a terminal having a large number of pins.
Figure 3:
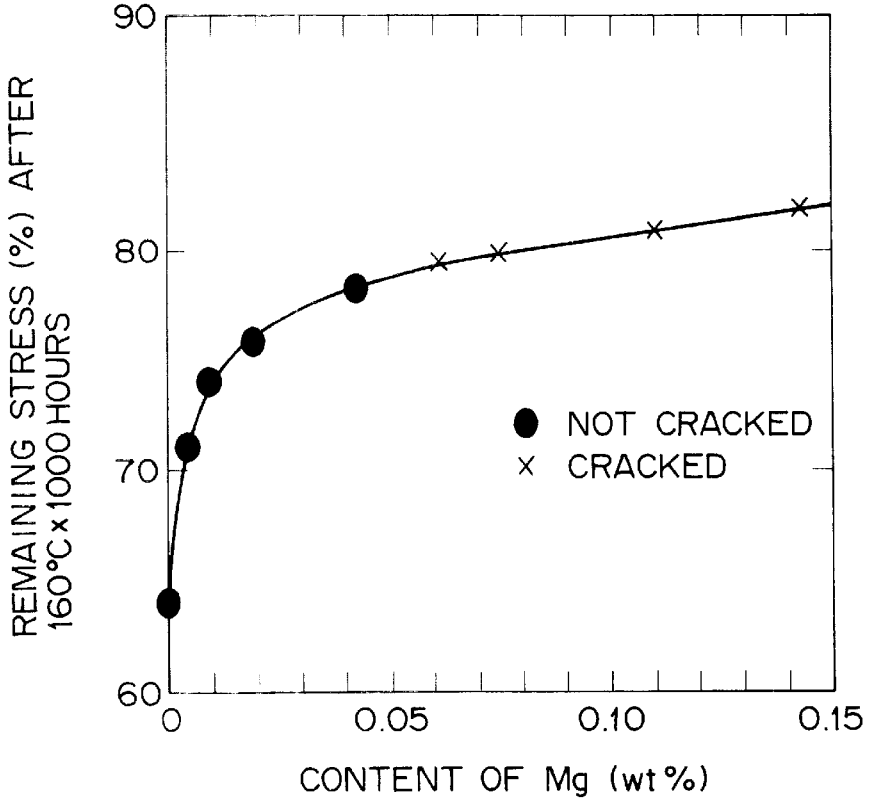
FIG. 3 is a graph showing the relation between the content of Mg and the stress relaxation resistance (remaining stress) and bend formability.

FIG. 3 shows the variation in the content of Mg in a Cu-1.8% Ni-0.4% Si composition in relation to the stress relaxation resistance characteristic (remaining stress after keeping at 160° C. for 1000 hours and the bend formability). The method of making samples, the measurement of stress relaxation resistance characteristic, and the bending test method used herein are, respectively, same as those described in examples. Through observation of a bent portion after the bend test, a sample having no generation of crack is plotted as ● and a sample suffering crack is indicated as X in the graph. As is particularly shown in FIG. 3, the remaining stress is sharply improved on addition of Mg only in very small amounts and, in fact, exceeds 70% when the content is at 0.005%. When the content of Mg exceeds 0.02%, the increase of the remaining stress becomes gentle. Crack is found to occur when the content is over 0.05%.

(Average Grain Size)

There are known many documents, which have referred to the relation between the bend formability and the grain. Most of them are unclear with respect to the measurement of a grain size, or with respect to whether or not measurement is made after recrystallization or whether or not measurement is made in the state of a final product (e.g. a sheet or strip in a state capable of serving for terminal or lead frame work after completion of rolling and thermal treatment). In the practice of the invention, an appropriate grain size has been determine based on the finding that the bend formability can be conveniently controlled by controlling a grain size value obtained by measurement along an axis vertical to the surface of a final copper alloy sheet. When the grain size is less than 3 μm, good bend formability is not obtained. When the grain size exceeds 20 μm, wrinkles on the surface become so large that crack is liable to occur. Thus, the average grain size is generally in the range of 3 to 20 μm, preferably 5 to 15 μm. It is to be noted that where a grain size is larger than the above-defined range after recrystallization, the generation of crack can be suppressed according to a subsequent working step wherein the grain size in a final product is controlled to be in the range of 3 to 20 μm. On the contrary, if a grain size after recrystallization is within an appropriate range (of 3 to 20 μm), crack may occur when a working rate in a subsequent step is so great that the grain size in a final product is smaller than 3 μm.

The copper alloy sheet of the invention exhibits a good heat resistance and does not undergo any structural change on heating at about 350° C. in maximum as is experienced at the time of setup of terminals and connectors or in a mounting step of semiconductors. Thus, it is considered that the average grain size, precipitate size, crystallographic orientation, yield strength and the like are kept in a state prior to the working of the sheet.

Figure 4:
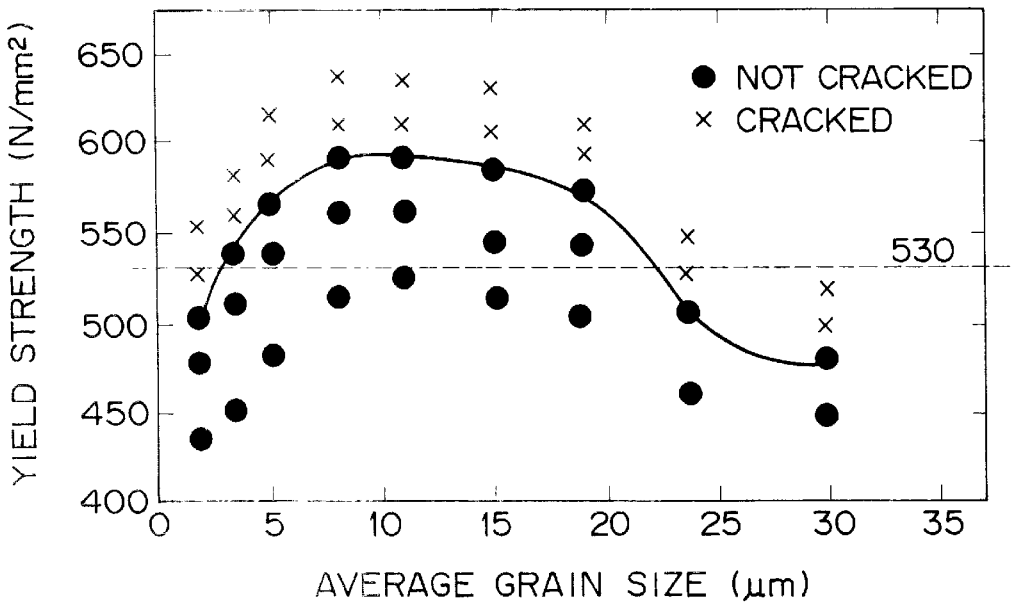
FIG. 4 is a graph showing the variation in yield strength and bend formability in relation to the average grain size.

FIG. 4 shows an average grain size, a yield strength and bend formability in relation to the variation in the grain size of an alloy having a Cu-1.8% Ni-0.4% Si-0.01% Mg composition. Samples for this are made in the same manner as in examples (provided that thermal treatment after cold rolling was changed under temperature and time conditions within ranges of from 675 to 875° C. and from 20 seconds to 10 minutes, and precipitation treatment after 30% of cold rolling was changed under temperature and time conditions within a range of from 450 to 500° C. and 2 hours). The methods of measuring a grain size and yield strength and a bending test method were, respectively, carried out in the same manner as in examples appearing hereinafter. The bent portion after the bending test was observed, and a sample undergoing no generation of crack is plotted as ● and a sample undergoing generation of crack is plotted as X in the graph. As shown in FIG. 4, a grain size, which ensures a yield strength of 530 N/mm$^2$ and good bend formability, is in the range of 3 to 20 μm. It is considered that with samples having a grain size less than 3 μm, the solution treatment temperature after cold roller is low, or the solution treatment time is short, so that grains are not satisfactorily restored in ductility, thus causing bend formability to be worsened. With samples whose grain size exceeds 20 μm, the grain size is so large that stress concentration is liable to occur at grain boundaries at the time of bending. Eventually, surface wrinkles become large, thus leading to intergranular crack.

(Sn)

In general, the solid solution of Sn in a Cu matrix improves strength. In the practice of the invention, it is aimed to produce an effect of significantly improving a stress relaxation resistance characteristic through co-existence with the intermetallic compound of Ni and Si and also with Mg in small amounts of Sn rather than to produce the strength-improving effect. When Sn is added to a Cu—Ni—Si alloy of the invention, the stress relaxation resistance characteristic is improved. However, if Sn<0.01 wt %, the improving effect is not satisfactory. The stress relaxation resistance characteristic is improved before the content of Sn is arrived at a certain level, but a higher content of Sn does not further improve the stress relaxation resistance characteristic with a lowering of bend formability. When Sn>0.3 wt %, bend formability considerably lowers, with the 180 degree bending at 0 radius becoming impossible. Accordingly, the content of Sn is in the range of 0.01 to 0.3 wt %, preferably 0.05 to 0.2 wt %.

In relation with the content of Mg, it is preferred that 0.03 ≦6[Mg]+[Sn]≦0.3. More particularly, when a value of 6[Mg]+[Sn] is less than 0.03 wt %, a satisfactory stress relaxation resistance characteristic is not obtained. When the value exceeds 0.3 wt %, bend formability degrades.

Figure 5:
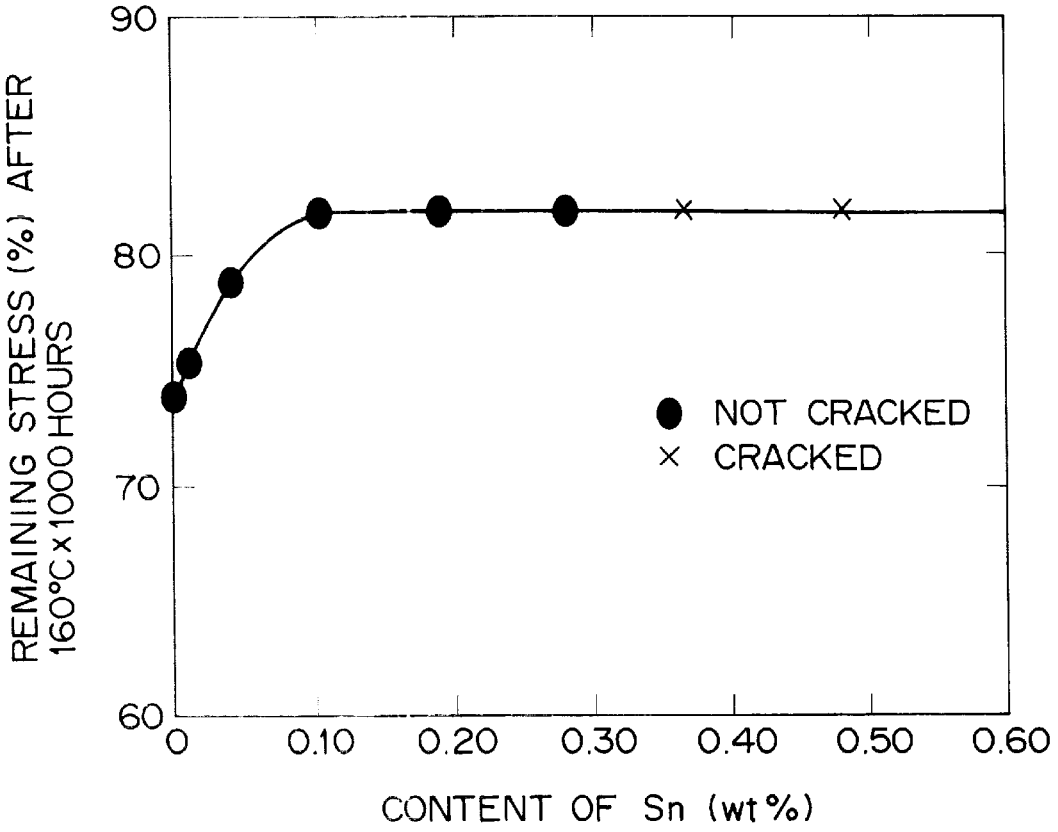
FIG. 5 is a graph showing the variation in stress relaxation resistance (remaining stress) and bend formability in relation to the content of Sn.

FIG. 5 shows the variation in stress relaxation resistance characteristic and bend formability in relation to the content of Sn when Sn is contained in an alloy having a Cu-1.8Ni-0.4% Si-0.0 1% Mg composition. The method of making samples, the method of measuring a stress relaxation resistance characteristic and a bending test method are, respectively, those illustrated in examples. Bent portions after the bending test were observed, and samples undergoing no occurrence of crack are plotted as ● and samples undergoing occurrence of crack is indicated as X in the figure. On comparison with Mg, the effect of improving the stress relaxation resistance characteristic is less. However, as shown in FIG. 5, the remaining stress is abruptly improved and arrives at a value exceeding 80% when the content is at 0.1%. The improvement of the remaining stress is substantially saturated at a level of 0.1. Over 0.3%, the alloy undergoes cracking.

(Zn)

Zn acts to improve a thermal resistance of a soldered layer to peel and a migration resistance. When Zn≦0.1 wt %, such an improving effect does not develop satisfactorily. On the contrary, when Zn>5 wt %, solderability lowers. Accordingly, the content of Zn is in the range of 0.01 to 5 wt %, preferably from 0.3 to 1.5 wt %.

(Mn, Cr)

Mn and Cr, respectively, serve to further improve the stress relaxation resistance characteristic when co-existing with the Ni-Si intermetallic compound. The improvement is not appreciable when the content of Mn is in the range of 0.01 wt % or below and the content of Cr is in the range of 0.001 wt % or below. The content of either of them exceeds 0.1 wt %, the improving effect is saturated, with a lowering of bend formability.

(Be and other elements)

Be, Al, Ca, Mn, Ti, V, Cr, Fe, Co, Zr, Nb, Mo, Ag, In , Pb, Hf, Ta, B and the like individually act to further improve yield strength on co-existence with the Ni-Si intermetallic compound. If the total amount of these elements exceeds 1 wt %, not only electrical conductivity lowers, but also bend formability lowers. Accordingly, the total amount of these elements is in the range of 1 wt % or below.

(Crystallographic Orientation)

The copper alloy according to the invention has increasing preferring ratios of {200} and {311} planes on or in the sheet surface with an increase in grain size after recrystallization. When rolled, the sheet increases in the preferring ratio of {220} plane. In the practice of the invention, appropriate preferring ratios, as is particularly shown hereinbefore, are determined based on our view that these planes has a strong interrelation with bend formability, and the bend formability can be appropriately controlled by controlling the preferring ratios of these planes in the sheet surface.

The copper alloy sheet of the invention can be made according to the following manufacturing procedure. In the manufacturing procedure, the preferring ratios can be controlled, as desired, by controlling, for example, heat treating conditions (including heating temperature and time) and a subsequent cold rolling step (e.g. a working rate). The preferring ratios do not appreciably change depending on the precipitation treatment or stress relief annealing.

(Yield strength)

When the yield strength is less than 530 N/mm$^2$, a high contact force cannot be obtained at a spring portion of a down-sized terminal.

The manufacturing method of the copper alloy of the invention is now described.

The copper alloy is melted and cast, after which it is subjected, if necessary, to homogenizing heat treatment and hot rolling, followed by cold rolling, heat treatment and quenching (which may be repeated, if necessary). Moreover, the copper alloy may be further cold rolled and then subjected to precipitation treatment, followed by cold rolling or stress relief annealing, if necessary, to obtain an intended copper alloy.

In the practice of the invention, it is essential to perform at least one cycle of a thermal treatment (solution treatment) under conditions of a temperature of 700 to 850° C. and a time shorter than 5 minutes especially for the thermal treatment on the way of the cold rolling step. If the thermal treating temperature is lower than 700° C., a recrystallized grain size becomes so small that a difficulty in involved in obtaining good bend formability along with unsatisfactory formation of an Ni—Si solid solution. On the contrary, when the temperature exceeds 850° C., the recrystallized grain size become too large, resulting in the formation of large wrinkles on bend forming. If a subsequent cold rolling rate is higher, the grain size defined in the present invention becomes small. However, this entails an increasing preferring ratio of the {220} plane, making it difficult to ensure good bend formability. In addition, the thermal treatment over 5 minutes not only is poor in economy, but also undesirably makes a large re-crystallized grain size, thus leading to large wrinkles occurring during the course of bend forming. In this case, if a subsequent cold rolling rate is high, the grain size defined in the invention becomes small as well. However, the preferring ratio of the {220} plane increases, making it difficult to ensure good bend formability.

When the thermal treatment is continued for 5 minutes or over, the intermetallic compound precipitates of Ni and Si may be made roughened or impurity elements (S, Pb, As, Bi, Se and the like) of low melting points maybe concentrated at the grain boundaries, resulting in a lowering of bend formability.

It will be noted that when the thermal treatment temperature on the way of cold rolling is lower or when the precipitation treatment temperature is higher, the size of the intermetallic compound precipitate of Ni and Si becomes larger. The crystallographic orientation index becomes smaller at a lower thermal treatment temperature or at a larger total value of subsequent cold rolling rates.

The invention is more particularly described by way of examples. Comparative examples are also described.

EXAMPLES

Copper alloys having constituent compositions indicated in Tables 1 and 2, respectively, melted in air in a Kryptol furnace under charcoal-covered conditions and each cast into a book mold to obtain an ingot having a size of 50 mm×80 mm×200 mm. The ingot was heated to 930° C. and hot rolled to a thickness of 15 mm, followed by immediate quenching in water. In order to eliminate oxide scales from the surfaces of the hot rolled material, the surfaces were cut off through a grinder. The material was cold rolled, followed by thermal treatment at 750° C. for 20 seconds, cold rolling to a degree of 30%, and precipitation treatment at 480° C. for 2 hours to obtain 0.25 mm thick sample materials (Nos. 1 to 43). The samples were provided for testing. Further, in order to obtain copper alloys having different grain sizes, intermetallic compound precipitate sizes and orientation indices, the copper alloy of No. 19 was subjected to cold rolling, after which it was thermally treated under different conditions within a range of 675 to 875° C.×20 sec. to 10 min., followed by cold rolling to a degree of 30%, precipitation treatment under different conditions within a range of 450 to 500° C.×2 hours and further subjecting part of the alloy to cold rolling and stress relief annealing to obtain 0.25 mm thick materials (Nos. 19-1 to 19-8) for testing.

TABLE 1

| | Main Components (wt %) | | | | | | | | Sub-components |
|---|---|---|---|---|---|---|---|---|---|
| No. | Cu | Ni | Si | Mg | Zn | Sn | Mn | Cr | (wt %) |
| 1 | balance | 0.8 | 0.2 | 0.008 | — | — | — | — | — |
| 2 | balance | 1.3 | 0.3 | 0.012 | — | — | — | — | — |
| 3 | balance | 1.8 | 0.4 | 0.011 | — | — | — | — | — |
| 4 | balance | 2.3 | 0.5 | 0.010 | — | — | — | — | — |
| 5 | balance | 1.8 | 0.4 | 0.003 | — | — | — | — | — |
| 6 | balance | 1.8 | 0.4 | 0.019 | — | — | — | — | — |
| 7 | balance | 1.8 | 0.4 | 0.028 | — | — | — | — | — |
| 8 | balance | 1.8 | 0.4 | 0.045 | — | — | — | — | — |
| 9 | balance | 1.8 | 0.4 | 0.011 | 0.03 | — | — | — | — |
| 10 | balance | 1.8 | 0.4 | 0.011 | 0.3 | — | — | — | — |
| 11 | balance | 1.8 | 0.4 | 0.011 | 1.1 | — | — | — | — |
| 12 | balance | 1.8 | 0.4 | 0.011 | 4.2 | — | — | — | — |
| 13 | balance | 1.8 | 0.4 | 0.002 | — | 0.01 | — | — | — |
| 14 | balance | 1.8 | 0.4 | 0.011 | — | 0.03 | — | — | — |
| 15 | balance | 1.8 | 0.4 | 0.011 | — | 0.11 | — | — | — |
| 16 | balance | 1.8 | 0.4 | 0.011 | — | 0.19 | — | — | — |
| 17 | balance | 1.8 | 0.4 | 0.011 | — | 0.28 | — | — | — |
| 18 | balance | 1.8 | 0.4 | 0.011 | 1.1 | 0.11 | — | — | — |
| 19 | balance | 1.8 | 0.4 | 0.011 | 1.1 | 0.11 | 0.04 | 0.005 | — |
| 20 | balance | 1.8 | 0.4 | 0.011 | 1.1 | 0.11 | 0.06 | 0.02 | — |
| 21 | balance | 1.8 | 0.4 | 0.011 | 1.1 | 0.11 | 0.02 | 0.08 | — |
| 22 | balance | 1.8 | 0.4 | 0.011 | 1.1 | 0.11 | 0.04 | 0.005 | Be: 0.02 Al: 0.05 |
| 23 | balance | 1.8 | 0.4 | 0.011 | 1.1 | 0.11 | 0.04 | 0.005 | Ti: 0.03 V: 0.005 |
| 24 | balance | 1.8 | 0.4 | 0.011 | 1.1 | 0.11 | 0.04 | 0.005 | Fe: 0.04 Co: 0.06 |

TABLE 1-continued

| No. | Main Components (wt %) Cu | Ni | Si | Mg | Zn | Sn | Mn | Cr | Sub-components (wt %) |
|---|---|---|---|---|---|---|---|---|---|
| 25 | balance | 1.8 | 0.4 | 0.011 | 1.1 | 0.11 | 0.04 | 0.005 | Zr: 0.03 Nb: 0.007 |
| 26 | balance | 1.8 | 0.4 | 0.011 | 1.1 | 0.11 | 0.04 | 0.005 | Ag: 0.03 In: 0.1 |
| 27 | balance | 1.8 | 0.4 | 0.011 | 1.1 | 0.11 | 0.04 | 0.005 | Hf: 0.008 Ta: 0.009 |
| 28 | balance | 1.8 | 0.4 | 0.011 | 1.1 | 0.11 | 0.04 | 0.005 | B: 0.01 |

TABLE 2

| No. | Main Components (wt %) Cu | Ni | Si | Mg | Zn | Sn | Mn | Cr | Sub-components (wt %) |
|---|---|---|---|---|---|---|---|---|---|
| 29 | balance | 0.3 | 0.1 | 0.008 | — | — | — | — | — |
| 30 | balance | 2.7 | 0.6 | 0.012 | — | — | — | — | — |
| 31 | balance | 0.8 | 0.03 | 0.011 | — | — | — | — | — |
| 32 | balance | 2.3 | 0.7 | 0.010 | — | — | — | — | — |
| 33 | balance | 1.8 | 0.4 | — | — | — | — | — | — |
| 34 | balance | 1.8 | 0.4 | 0.062 | — | — | — | — | — |
| 35 | balance | 1.8 | 0.4 | 0.011 | 6.1 | — | — | — | — |
| 36 | balance | 1.8 | 0.4 | 0.011 | 1.1 | 0.39 | — | — | — |
| 37 | balance | 1.8 | 0.4 | 0.011 | 1.1 | 0.11 | 0.15 | 0.005 | — |
| 38 | balance | 1.8 | 0.4 | 0.011 | 1.1 | 0.11 | 0.04 | 0.18 | — |
| 39 | balance | 1.8 | 0.4 | 0.011 | 1.1 | 0.11 | 0.04 | 0.005 | Be:0.02Al:1.2 |
| 40 | balance | 1.8 | 0.4 | 0.011 | 1.1 | 0.11 | 0.04 | 0.005 | Ti:0.05Co:1.3 |
| 41 | balance | 1.8 | 0.4 | 0.011 | 1.1 | 0.11 | 0.04 | 0.005 | Fe:1.1Zr:0.03 |
| 42 | balance | 1.8 | 0.4 | 0.011 | 1.1 | 0.11 | 0.04 | 0.005 | Ta:0.009In:1.1 |
| 43 | balance | 1.8 | 0.4 | 0.011 | 1.1 | 0.11 | 0.04 | 0.005 | Ag:1.2B:0.01 |

*The underlined indicates contents outside the scope of the invention.

The test materials were, respectively, checked according to following procedures with respect to tensile strength, yield strength, electrical conductivity, 180 degree bending at 0 radius, grain size, precipitate size, crystallographic orientation and thermal resistance of a soldered layer to peel. The results are shown in Tables 3 to 6.

Tensile strength, yield strength: determined according to a method described in JIS Z 2241. It is to be noted that the yield strength adopted was one at an elongation set of 0.2% determined by an off-set method. The respective samples were tested with a test number, n.=2 and the average values thereof were used. A test piece was No. 5 test piece described in JIS Z 2201, and the direction of pull of each test piece was determined parallel to the rolling direction.

Electrical conductivity: determined by a method described in JIS H 0505. The measurement of an electrical resistance was made by use of a double bridge.

180 degree bending at 0 radius: determined by a method described in JIS Z 2248. A test piece width was determined at 10 mm and was bent at 180 degrees under a load of 1 ton. A sampling direction of a test piece was in G.W. (good way wherein the bending axis is vertical to the rolling direction) and in B.W. (bad way wherein the bending axis is parallel to the rolling direction). After the test, the bent line of each sample was observed through a stereoscopic microscope with 40 magnifications, whereupon samples were selectively divided into good ones (suffering no cracking without large wrinkles), ones undergoing large wrinkles, and cracked ones. The respective samples were subjected to 180 degree bending at 0 radius each at n=5. If one of the five test samples suffered large wrinkles or cracking, such a sample group was judged as wrinkled or cracked. It will be noted that a sample, whose wrinkles and cracks were unlikely to be discriminated from each other upon observation of the bent line through the stereoscopic microscope, was cut along a section vertical to the bent line, and the cut plane was polished and observed through an optical microscope (with 50 to 100 magnifications), from which the presence or absence of cracks was judged.

Average grain size: measured along an axis vertical to a sheet surface according to a cutting method described in JIS H 0501. The measurements were for sample materials (with a thickness of 0.25 mm) obtained after completion of a fabricating process, not after completion of re-crystallization as ordinarily used for this purpose. Samples were taken from five portions of a sheet at its central portion along the width thereof, and each sample was measured at five portions thereof. Thus, an average value of 25 measurements was provided as an average grain size of the sample. In the copper alloy of the invention, the values of the grain size at the measured sites do not vary so much, and substantially same measurements were obtained.

Size of Ni—Si intermetallic compound precipitate: a sample was photographed from two fields of view through a transmission electron microscope at 60,000 magnifications, and an average grain size of the largest compound precipitate to the fifth largest compound precipitate was determined for use as a compound precipitate size.

Crystal orientation: after completion of fabrication steps, an X-ray was incident on a surface of a test sample (with a thickness of 0.25 mm) to measure intensities from individual diffraction planes. Among the intensities, the ratios of diffraction intensities at {200}, {311} and {220}, which had strong interrelation with bend formability, were compared with one another, and a value of [I{200}+I{311}]/I{220} was calculated. It will be noted that X-ray irradiation conditions were such that the kind of X-ray was Cu K-α1, a tube voltage was at 40 kV, and a tube current was at 200 mA., and measurement was made while rotating a sample on its own axis.

Stress relaxation resistance characteristic: checked by use of a cantilever block technique described in EMAS-3003 wherein an initial stress was set at 80% of yield strength under which a remaining stress after keeping at 160° C. for 1000 hours was measured. The test was conducted at n=5 for individual samples, and an average value was provided as a remaining stress of a sample.

Thermal resistance of a soldered layer to peel: after application of a weakly active flux, a material was immersed and soldered in a 6Sn/4Pb solder bath at 245° C. for 5 seconds, and kept in a thermostatic furnace at 150° C. for 1000 hours, after which the resistance was checked. The checking method was such that the material was bent at 180° along a circle with a radius of 1 mm, and returned to a flat sheet to observe the presence or absence of solder peeling. Sampling was made after 250 hours, 500 hours, 750 hours and 1000 hours kept in the furnace. The resistance was indicated in terms of a maximum time before peeling took place.

TABLE 3

| No. | tensile strength ($N/mm^2$) | yield strength ($N/mm^2$) | electrical conductivity (% IACS) | 180 degree bending at 0 radius G.W | 180 degree bending at 0 radius B.W | grain size (μm) | compound precipitate size (μm) |
|---|---|---|---|---|---|---|---|
| 1 | 540 | 480 | 52 | good | good | 8 | 0.1 |
| 2 | 580 | 520 | 51 | good | good | 8 | 0.1 |
| 3 | 640 | 580 | 50 | good | good | 8 | 0.1 |
| 4 | 680 | 620 | 49 | large wrinkle | large wrinkle | 8 | 0.1 |
| 5 | 640 | 580 | 50 | good | good | 8 | 0.1 |
| 6 | 640 | 580 | 50 | good | good | 8 | 0.1 |
| 7 | 650 | 590 | 49 | good | good | 8 | 0.1 |
| 8 | 650 | 590 | 49 | good | good | 8 | 0.1 |
| 9 | 640 | 580 | 50 | good | good | 8 | 0.1 |
| 10 | 640 | 580 | 49 | good | good | 8 | 0.1 |
| 11 | 640 | 580 | 48 | good | good | 8 | 0.1 |
| 12 | 640 | 580 | 45 | good | good | 8 | 0.1 |
| 13 | 640 | 580 | 50 | good | good | 8 | 0.1 |
| 14 | 640 | 580 | 50 | good | good | 8 | 0.1 |
| 15 | 640 | 580 | 49 | good | good | 8 | 0.1 |
| 16 | 640 | 580 | 48 | good | good | 8 | 0.1 |
| 17 | 650 | 590 | 47 | large wrinkle | large wrinkle | 8 | 0.1 |
| 18 | 640 | 580 | 47 | good | good | 8 | 0.1 |
| 19 | 640 | 580 | 47 | good | good | 8 | 0.1 |
| 20 | 640 | 580 | 47 | good | good | 8 | 0.1 |
| 21 | 640 | 580 | 47 | good | good | 8 | 0.1 |
| 22 | 670 | 610 | 45 | good | good | 8 | 0.1 |
| 23 | 670 | 610 | 46 | good | good | 8 | 0.1 |
| 24 | 660 | 600 | 45 | good | good | 8 | 0.1 |
| 25 | 650 | 590 | 46 | good | good | 8 | 0.1 |
| 26 | 660 | 600 | 45 | good | good | 8 | 0.1 |
| 27 | 650 | 590 | 47 | good | good | 8 | 0.1 |
| 28 | 650 | 590 | 47 | good | good | 8 | 0.1 |
| 19-1 | 640 | 580 | 47 | large wrinkle | large wrinkle | 4 | 0.1 |
| 19-2 | 640 | 580 | 47 | large wrinkle | large wrinkle | 18 | 0.1 |
| 19-3 | 620 | 560 | 47 | large wrinkle | large wrinkle | 8 | 0.25 |
| 19-4 | 640 | 580 | 47 | large wrinkle | large wrinkle | 8 | 0.1 |

TABLE 4

| No. | crystallographic orientation [I \|200\| + I \|311\|]/ I \|220\| | remaining stress after resistance relaxation resistance at 160° C. for 1000 hours | thermal resistance of soldered layer to peel (hours) | 6[Mg]+ [Sn] (wt %) |
|---|---|---|---|---|
| 1 | 0.70 | 70 | 750 | 0.048 |
| 2 | 0.70 | 72 | 500 | 0.072 |
| 3 | 0.70 | 74 | 500 | 0.066 |

TABLE 4-continued

| No. | crystallographic orientation [I \|200\| + I \|311\|]/ I \|220\| | remaining stress after resistance relaxation resistance at 160° C. for 1000 hours | thermal resistance of soldered layer to peel (hours) | 6[Mg]+ [Sn] (wt %) |
|---|---|---|---|---|
| 4 | 0.70 | 75 | 250 | 0.060 |
| 5 | 0.70 | 72 | 500 | 0.018 |
| 6 | 0.70 | 75 | 500 | 0.114 |
| 7 | 0.70 | 76 | 500 | 0.168 |
| 8 | 0.70 | 77 | 500 | 0.270 |
| 9 | 0.70 | 74 | 750 | 0.066 |
| 10 | 0.70 | 74 | 1000 | 0.066 |
| 11 | 0.70 | 74 | 1000 | 0.066 |
| 12 | 0.70 | 74 | 1000 | 0.066 |
| 13 | 0.70 | 75 | 500 | 0.022 |
| 14 | 0.70 | 79 | 500 | 0.096 |
| 15 | 0.70 | 82 | 500 | 0.176 |

TABLE 4-continued

| No. | crystallographic orientation [I \|200\| + I \|311\|]/ I \|220\| | remaining stress after resistance relaxation resistance at 160° C. for 1000 hours | thermal resistance of soldered layer to peel (hours) | 6[Mg]+ [Sn] (wt %) |
|---|---|---|---|---|
| 16 | 0.70 | 82 | 500 | 0.256 |
| 17 | 0.70 | 82 | 500 | 0.346 |
| 18 | 0.70 | 82 | 1000 | 0.176 |

TABLE 4-continued

| No. | crystallographic orientation [I \|200\| + I \|311\|]/ I \|220\| | remaining stress after resistance relaxation resistance at 160° C. for 1000 hours | thermal resistance of soldered layer to peel (hours) | 6[Mg]+ [Sn] (wt %) |
|---|---|---|---|---|
| 19 | 0.70 | 85 | 1000 | 0.176 |
| 20 | 0.70 | 85 | 1000 | 0.176 |
| 21 | 0.70 | 85 | 1000 | 0.176 |
| 22 | 0.70 | 86 | 1000 | 0.176 |
| 23 | 0.70 | 86 | 1000 | 0.176 |
| 24 | 0.70 | 86 | 1000 | 0.176 |
| 25 | 0.70 | 86 | 1000 | 0.176 |
| 26 | 0.70 | 86 | 1000 | 0.176 |
| 27 | 0.70 | 86 | 1000 | 0.176 |
| 28 | 0.70 | 86 | 1000 | 0.176 |
| 19-1 | 0.70 | 85 | 1000 | 0.176 |
| 19-2 | 0.70 | 85 | 1000 | 0.176 |
| 19-3 | 0.70 | 81 | 1000 | 0.176 |
| 19-4 | 0.55 | 85 | 1000 | 0.176 |

TABLE 6-continued

| No. | crystallographic orientation [I \|200\| + I \|311\|]/ I \|220\| | remaining stress after resistance relaxation resistance at 160° C. for 1000 hours | thermal resistance of soldered layer to peel (hours) | 6[Mg]+ [Sn] (wt %) |
|---|---|---|---|---|
| 41 | 0.70 | 86 | 1000 | 0.176 |
| 42 | 0.70 | 86 | 1000 | 0.176 |
| 43 | 0.70 | 86 | 1000 | 0.176 |
| 19-5 | 0.70 | 84 | 1000 | 0.176 |
| 19-6 | 0.70 | 85 | 1000 | 0.176 |
| 19-7 | 0.70 | 78 | 1000 | 0.176 |
| 19-8 | 0.42 | 85 | 1000 | 0.176 |

*The underlined indicates a portion where the characteristic is poor.

The results of these tables reveal that the alloy Nos. 1 to 28 and 19-1 to 19-4 of the invention exhibit good characteristic properties. It should be noted, however, that alloy No. 4 has a relatively high value of Ni/Si, alloy No. 17 has a high value of 6[Mg]+[Sn], alloy No. 19-1 is relatively small in grain size, alloy No. 19-2 is relatively large in grain size, alloy No. 19-3 is relatively large in compound precipitate size, and alloy No. 19-4 is relatively low in crystallographic orientation index. Accordingly, these alloys suffer large wrinkles when subjected to 180 degree bending at 0 radius. However, all of the alloys do not suffer cracking, and thus, can be employed for electronic parts without involving any substantial problem. Alloy No. 13 is relatively low in the value of 6[Mg]+[Sn], so that the stress relaxation resistance is slightly lower than those alloys having both Mg and Sn added thereto. Alloy No. 19-3 is relatively large in compound precipitate size, so that the stress relaxation resistance characteristic is relatively low.

On the other hand, comparative alloy Nos. 29 and 31 are so low in content of Ni or Si that the yield strength and the stress relaxation resistance characteristic are both low. Alloy Nos. 30 and 32 are high in Ni or Si content, so that when subjected to 180 degree bending at 0 radius, they suffer cracking. Alloy No. 33 is free of Mg and its stress relaxation

TABLE 5

| No. | tensile strength ($N/mm^2$) | yield strength ($N/mm^2$) | electrical conductivity (% IACS) | 180 degree bending at 0 radius G.W | 180 degree bending at 0 radius B.W | grain size (μm) | Compound precipitate size (μm) |
|---|---|---|---|---|---|---|---|
| 29 | 460 | 400 | 54 | good | good | 8 | 0.1 |
| 30 | 700 | 660 | 48 | cracked | cracked | 8 | 0.1 |
| 31 | 480 | 420 | 55 | good | good | 8 | 0.1 |
| 32 | 680 | 620 | 40 | cracked | cracked | 8 | 0.1 |
| 33 | 630 | 570 | 51 | good | good | 8 | 0.1 |
| 34 | 660 | 600 | 48 | cracked | cracked | 8 | 0.1 |
| 35 | 640 | 580 | 42 | good | good | 8 | 0.1 |
| 36 | 650 | 590 | 42 | cracked | cracked | 8 | 0.1 |
| 37 | 640 | 580 | 42 | cracked | cracked | 8 | 0.1 |
| 38 | 650 | 590 | 45 | cracked | cracked | 8 | 0.1 |
| 39 | 700 | 660 | 36 | cracked | cracked | 8 | 0.1 |
| 40 | 680 | 620 | 38 | cracked | cracked | 8 | 0.1 |
| 41 | 680 | 620 | 37 | cracked | cracked | 8 | 0.1 |
| 42 | 660 | 600 | 39 | cracked | cracked | 8 | 0.1 |
| 43 | 650 | 590 | 46 | cracked | cracked | 8 | 0.1 |
| 19-5 | 620 | 560 | 48 | cracked | cracked | 2 | 0.1 |
| 19-6 | 650 | 590 | 47 | cracked | cracked | 23 | 0.1 |
| 19-7 | 580 | 520 | 48 | cracked | cracked | 8 | 0.4 |
| 19-8 | 680 | 650 | 46 | cracked | cracked | 8 | 0.1 |

*The underlined indicates a portion where the characteristic is poor.

TABLE 6

| No. | crystallographic orientation [I \|200\| + I \|311\|]/ I \|220\| | remaining stress after resistance relaxation resistance at 160° C. for 1000 hours | thermal resistance of soldered layer to peel (hours) | 6[Mg]+ [Sn] (wt %) |
|---|---|---|---|---|
| 29 | 0.70 | 64 | 750 | 0.048 |
| 30 | 0.70 | 75 | 250 | 0.072 |
| 31 | 0.70 | 70 | 750 | 0.066 |
| 32 | 0.70 | 75 | 250 | 0.060 |
| 33 | 0.70 | 64 | 500 | 0 |
| 34 | 0.70 | 78 | 500 | 0.372 |
| 35 | 0.70 | 74 | 1000 | 0.066 |
| 36 | 0.70 | 82 | 1000 | 0.456 |
| 37 | 0.70 | 85 | 1000 | 0.176 |
| 38 | 0.70 | 86 | 1000 | 0.176 |
| 39 | 0.70 | 86 | 1000 | 0.176 |
| 40 | 0.70 | 86 | 1000 | 0.176 |

resistance characteristic is low. Alloy Nos. 34 to 43 are higher in content of any of components, so that they suffer cracking when subjected to 180 degree bending at 0 radius, or electrical conductivity is low.

Alloy No. 19-5 is smaller in grain size, so that it suffers cracking when subjected to 180 degree bending at 0 radius. Alloy No. 19-6 is larger in grain size, so that it suffers cracking when subjected to 180 degree bending at 0 radius. Alloy No. 19-7 is larger in compound precipitate size, so that it suffers cracking when subjected to 180 degree bending at 0 radius, along with low stress relaxation resistance and low yield strength. Alloy No. 19-8 is lower in crystallographic orientation index and suffers cracking when subjected to 180 degree bending at 0 radius.

As will be apparent form the foregoing, the copper alloy of the invention have good yield strength, electrical conductivity, stress relaxation resistance characteristic and good formability sufficient to ensure 180 degree bending at 0 radius, and is suitable for use as terminals, connectors, switches, relays, lead frames and the like.

What is claimed is:

1. A copper alloy sheet, which consists essentially of 0.4 to 2.5 wt % of Ni, 0.05 to 0.6 wt % of Si, 0.001 to 0.05 wt % of Mg, and at least one element selected from the group consisting of 0.01 to 0.1 wt % of Mn, and 0.001 to 0.1 wt % of Cr; the balance being Cu and inevitable impurities wherein an average grain size in the sheet is in the range of 3 to 20 $\mu$m, and a size of an intermetallic compound precipitate of Ni and Si is in the range of 0.3 $\mu$m or below.

2. The copper alloy sheet of claim 1, which further consists of 0.01 to 5 wt % of Zn.

3. The copper alloy sheet of claim 1, which further consists of 0.01 to 0.3 wt % of Sn.

4. The copper alloy sheet of claim 1, which further consists of 0.01 to 5 wt % of Zn, and 0.01 to 0.3 wt % of Sn.

5. The copper alloy sheet of claim 1, wherein when content by wt % of Mg is represented by (Mg) and content by wt % of Sn is represented by (Sn), the following equation is satisfied:

$$0.03 \leqq 6(Mg)+(Sn) \leqq 0.3.$$

6. The copper alloy sheet of claim 1, which further consists of at least one element selected from the group consisting of Be, Al, Ca, Ti, V, Fe, Co, Zr, Nb, Mo, Ag, In, Pb, Hf, Ta and B in a total amount of 1 wt % or below.

7. The copper alloy sheet of claim 1, wherein said sheet has a yield strength of 530 N/mm$^2$ or above.

8. The copper alloy sheet of claim 1, which exhibits 180 degree bending at 0 radius.

9. The copper alloy sheet of claim 1, wherein said Ni is present in an amount of 1.5 to less than 2.0 wt. %.

10. The copper alloy sheet of claim 1, wherein said Si is present in an amount of 0.3 to 0.5 wt. %.

11. The copper alloy sheet of claim 1, wherein said size of said intermetallic compound precipitate of Ni and Si is in the range of 0.2 $\mu$m or below.

12. The copper alloy sheet of claim 1, wherein said Mg is present in an amount of 0.005 to 0.03 wt. %.

13. The copper alloy sheet of claim 1, wherein said average grain size is 5 to 15 $\mu$m.

14. The copper alloy sheet of claim 3, wherein said Sn is present in an amount of from 0.05 to 0.2 wt. %.

15. The copper alloy sheet of claim 1, which is heat-resistant such that it exhibits no structural change upon heating up to about 350° C.

16. The copper alloy sheet of claim 15, wherein said no structural change comprises no change in average grain size, precipitate size or crystallographic orientation.

17. The copper alloy sheet of claim 4, wherein said Zn is present in an amount of from 0.3 to 1.5 wt. %.

* * * * *

UNITED STATES PATENT AND TRADEMARK OFFICE

CERTIFICATE OF CORRECTION

PATENT NO. : 6,334,915
DATED : January 1, 2002
INVENTOR(S) : Ogura et al.

It is certified that error appears in the above-identified patent and that said Letters Patent is hereby corrected as shown below:

Title page,
Item [73], the Assignee should read:
-- [73] Assignee: Kabushiki Kaisha Kobe Seiko Sho,
Kobe (JP) --

Signed and Sealed this

Seventh Day of May, 2002

*Attest:*

*Attesting Officer*

JAMES E. ROGAN
*Director of the United States Patent and Trademark Office*